US005277370A

United States Patent [19]

Schatz

[11] Patent Number: 5,277,370

[45] Date of Patent: Jan. 11, 1994

[54] VERTICAL IMPACT MILL WITH COUPLED MATERIAL CLASSIFICATION

[75] Inventor: Peter Schatz, Ennigerloh, Fed. Rep. of Germany

[73] Assignee: O&K Orenstein & Koppel AG, Berlin, Fed. Rep. of Germany

[21] Appl. No.: 779,005

[22] PCT Filed: Feb. 8, 1991

[86] PCT No.: PCT/EP91/00236

§ 371 Date: Aug. 24, 1992

§ 102(e) Date: Aug. 24, 1992

[87] PCT Pub. No.: WO91/12892

PCT Pub. Date: Sep. 5, 1991

[30] Foreign Application Priority Data

Feb. 22, 1990 [DE] Fed. Rep. of Germany ..... 4005555

[51] Int. Cl.[5] ..... B02C 23/08; B07B 7/083

[52] U.S. Cl. ..... 241/80; 241/19; 241/225

[58] Field of Search ..... 241/19, 24, 48, 80, 241/275

[56] References Cited

U.S. PATENT DOCUMENTS 2,350,737 6/1944 Eiben .
5,114,131 5/1992 Strasser et al. ..... 241/80 X
5,203,511 4/1993 Ohdush et al. ..... 241/19
5,215,262 6/1993 Binder ..... 241/19

FOREIGN PATENT DOCUMENTS 0118782 9/1984 European Pat. Off. .
576895 5/1933 Fed. Rep. of Germany .
3823380 1/1990 Fed. Rep. of Germany .
3844178 7/1990 Fed. Rep. of Germany .

*Primary Examiner*—Douglas D. Watts
*Attorney, Agent, or Firm*—Spencer, Frank & Schneider

[57] ABSTRACT

A device for crushing and screening bulk materials consists of a vertical impact mill with associated feeder, an air-charged separator, a discharge device for the final product and a conveyor for returning the insufficiently crushed bulk materials fraction to the crushing region. The vertical impact mill and the separator are arranged on a divided drive shaft, which can be coupled if necessary. The separator is arranged below the vertical impact mill and is designed as a distributor plate, possibly with guide blades. The air is introduced laterally or tangentially below the distributor plate. The finished materials fraction is discharged laterally or tangentially above the distributor plate and conveyed to separator (cyclone) which may be connected downstream. The insufficiently crushed bulk materials fractions are discharged through an outlet below the distributor plate in the base region of the separator. The outlet co-operates with the conveying device which returns the bulk materials fractions to the region of the feeder.

15 Claims, 1 Drawing Sheet

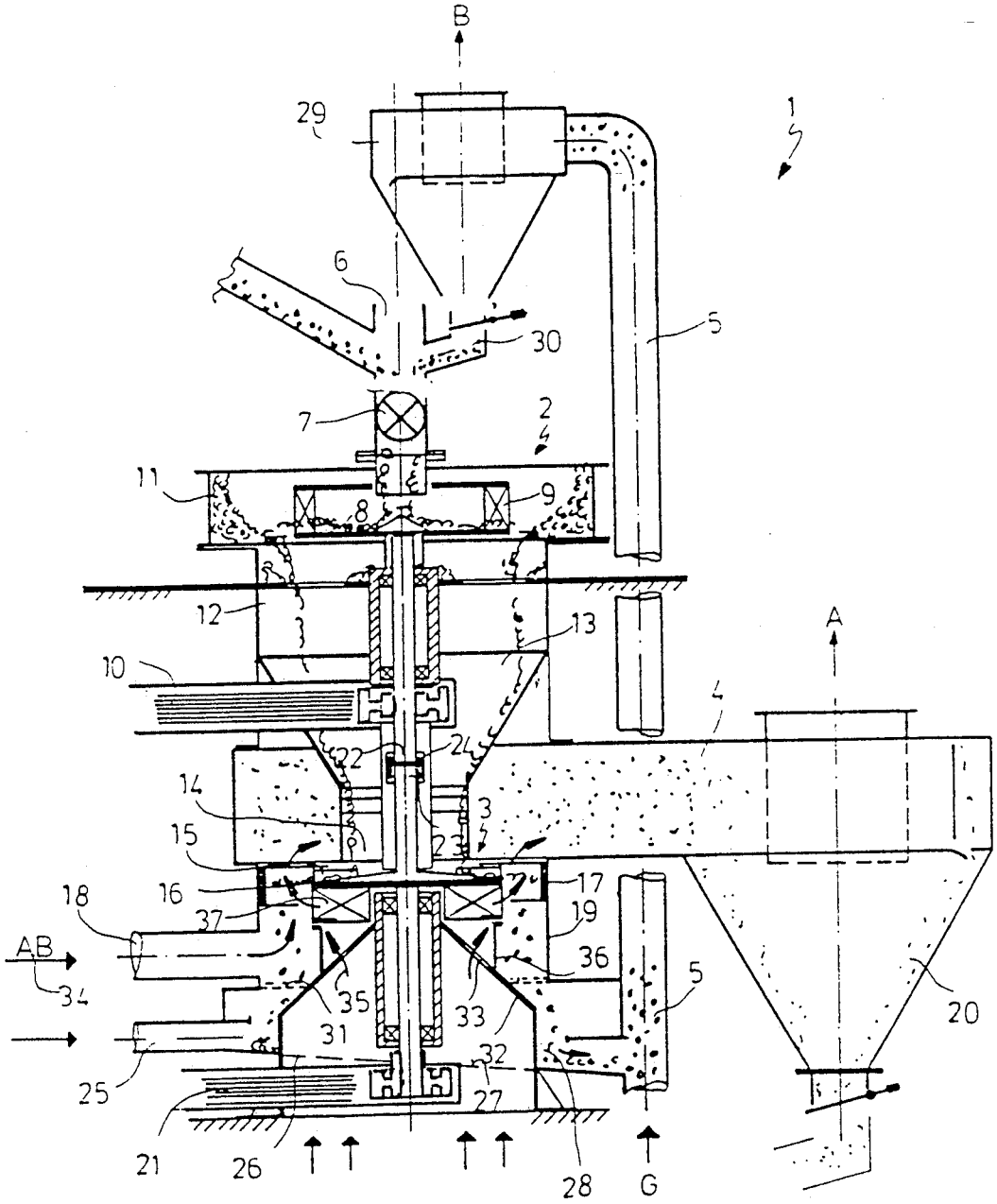
B
29
1
6
30
5
7
2
11
8
9
12
13
A
10
4
22
24
14
3
15
23
16
17
18
37
19
AB
36
34
35
5
20
31
33
32
25
27
21
26
28
G

VERTICAL IMPACT MILL WITH COUPLED MATERIAL CLASSIFICATION

The invention relates to a device for comminuting and classifying bulk materials, the device including a vertical impact mill equipped with an associated material charging device, a screening device charged with air, a finished material discharging device as well as a conveying device for returning the insufficiently comminuted fraction of the bulk material into the comminution region.

German Patent 576,895 discloses a mill charging device that includes a comminuting device equipped with a centrifuging plate that is surrounded by an impact wall. Below the plane of the impact ring, a blower wheel is provided that is driven together with the impact ring and generates a stream of air that crosses the stream of material dropping down from the impact ring. The fine material fraction is transported to a cyclone by the rising air where the fine fraction is discharged at the bottom and the exhaust air is made available again to the blower. The coarse fraction is fed to a grinding system provided below the vertical impact mill. The drawbacks of this device are essentially that the screening air is able to also penetrate into the region of the vertical impact mill which might, under certain circumstances, create undesirable flow conditions that could adversely affect the comminution process. Additionally, a further grinding device must be provided in order to further comminute the insufficiently comminuted bulk material fraction. This measure makes the device more complicated and also more expensive.

European Patent 118,782 discloses a comminuting apparatus and a screening device which are each equipped with a vertical shaft, with the comminuting device being provided in the lower region of the system and being charged with material by means of a worm-shaped feeder. The material introduced through the worm encounters an upwardly directed stream of air which is supplied below the comminuting apparatus and is intended to bring the material into the region of the comminuting device formed by at least one rotating impeller wheel. The stream of air should then carry the comminuted and any not yet sufficiently comminuted bulk material further upward into the region of a rotating screening device where a further classification takes place. The fine fraction is discharged above the screening device through a collecting pipe while coarser material, on the one hand, is reintroduced into the feeder and, on the other hand, is to be conducted to the comminuting device through corresponding recesses outside of the air stream. Between the comminuting device and the screening device, a further gas intake is provided and a type of perforated metal sheet is disposed above the gas conduit through which the gas entering from the gas intake flows upwardly. The drawback of such a structure is that a relatively large amount of air is required to ensure an upwardly directed flow over the entire interior cross section of the comminuting device. The vane or vanes provided with striking tools produces a flow component in the circumferential direction which must be overcome by the upwardly directed stream of air. This is particularly applicable for a stream of air charged with the coarse fraction. The same also applies for the second externally supplied gas source whose direction of flow is essentially radial and must first be converted into an axial component. In addition to the relatively complicated structure of the device, flow conditions are disclosed here which are hardly realizable in practice and thus make the overall operation of the system questionable.

Applicant's German Patent Application P 3,844,178.0, now published as DE-OS 3844178A1 on Jul. 5th, 1990, relates to a method and a device for comminuting bulk materials in which the material is charged vertically from the top into a comminuting device and is discharged subsequent to the comminution process. The material is introduced into a first acceleration device and is conducted by it onto a first material pile, with the fine-grained comminution products from this first comminution process being discharged by means of an upwardly directed stream of air or gas; coarser grains flow toward the bottom and are conducted by means of a stream of air or gas to at least one further acceleration device which places the material onto corresponding further material piles. The fine grained comminution products resulting from the comminution work are discharged by the already mentioned stream of air or gas while the coarser grains flow downward and are again put into circulation. In such a circulatory system there exists the advantage of an extremely compact structure so that further conveying devices provided outside of the system for the coarse fraction are not required. Since the supply of air is also provided over a relatively small cross section, the upward transport of the insufficiently comminuted bulk material fraction seems to pose no problems. However, since the air must have a sufficient flow velocity also in the region of the larger cross section above the second comminution stage, so as to be able to discharge the fine fraction, the flow components of the first comminution stage which act in the circumferential direction and tangentially thereto, respectively, may under certain circumstances have an adverse influence on the comminution process so that the fine fraction to be discharged may possibly not correspond to the predicted performance capability of the machine.

Based on the preamble of the first claim, the invention has as its object to organize the complex processes within the machine and to thus make them better controllable and to increase the efficiency of the individual processes within the machine.

This is accomplished by the following combinations of features:

the vertical impact mill and the screening device are disposed on a divided, possibly couplable, drive shaft;

the screening device provided below the vertical impact mill is configured as a distributing plate that is equipped with guide vanes if required;

the air supply is provided laterally or tangentially below the distributing plate;

the final fractions are discharged laterally or tangentially above the distributing plate;

the insufficiently comminuted fractions of the bulk material are discharged below the distributing plate and are supplied to the conveyor which returns the bulk material fraction into the region of the feeder device.

Advantageous features of the invention are defined in the dependent claims.

The combination of the above features overcomes the drawbacks of the prior art even in a slightly more complicated configuration. The functions of comminuting and classifying as well as resupplying the insufficiently comminuted bulk material fractions are here separated from one another, with comminution and classification continuing to be realized in one and the same machine. The advantage over the prior art is essentially that no undesired upward flow of the classifying air reaches the comminution region where it could possibly have an adverse influence on the comminuting work. The same applies to the renewed intake of the oversize grains. Coupling the two drive shafts appears to be appropriate for this reason in that if one or the other drive is malfunctioning, the machine can continue to be operated. Two drives result in the advantage that different numbers of revolutions can be realized for the vertical impact mill and the screening device.

Through a bypass conduit, part of the screening air is preferably employed simultaneously for the discharge of the insufficiently comminuted bulk material fraction, with the coarse components dropping to the bottom through the screening air being put into a spiral or circular motion by means of the discharging air and being discharged in the region of the discharge opening or openings to be directly charged onto the conveying device.

If required, the distribution plate may be provided with guide vanes (subsequent comminution wheel) which, under certain circumstances, are surrounded by a further impact wall and thus are able to effect further comminution.

The conveying device may be a conventional bucket mechanism which introduces the oversize grains directly into the region of the material charging device above the vertical impact mill. However, as an alternative, a riser pipe may also be provided which transports the insufficiently comminuted bulk material fraction upwardly by means of a stream of air. Preferably a separator should here be provided to separate the bulk material from the stream of air so that no wrong air is conducted into the region of the vertical impact mill.

If the laterally supplied quantity of air should be insufficient to effect a clean separation of the fine fraction from the coarse fraction, it is possible, if the lower screening device housing is configured accordingly, to supply additional fresh air from the bottom, in which case flow impediments for the individual streams of air are avoided by way of specially arranged air exit openings in the housing. The additional supply of fresh air appears to be appropriate if the screening device constitutes a further comminution stage and the further comminution work taking place here causes interference with the upward flow of the air.

One embodiment of the invention is illustrated in the drawing and will now be described as follows.

The sole drawing FIGURE is a longitudinal sectional view of a device 1 according to the invention which includes the following components:

a vertical impact mill 2, a screening device 3, a finished material discharging device 4 and a conveying device 5 for returning the insufficiently comminuted bulk material fraction into the region of a material charging device 6 that is disposed above the vertical impact mill 2. The material is introduced, for example, by way of a cellular wheel sluice 7 into the material charging device 6 which is configured as a chute so that no wrong air is able to enter the system. The material drops onto a distribution plate 8 that is equipped with guide vanes 9. Distribution plate 8 can be driven to rotate by means of a drive 10. By means of guide vanes 9, the incoming material is dumped onto a pile 11 in which most of the comminuting work takes place. Except for the air stream generated by the ventilator effect of the guide vanes, which has an essentially radial or tangential orientation, respectively, no interfering air influences exist here from possibly rising or externally supplied air.

Once the pile of material has been established, the already sufficiently comminuted as well as the insufficiently comminuted bulk material fractions flow downwardly through funnels 12 and 13 and are charged in the funnel discharge region 14 onto a distribution plate 16 that may be equipped with vanes 15 if required. If vanes 15 are provided on distribution plate 16, the arrangement of a circumferential impact wall 17 may serve to realize further comminution which, however, is not necessary in every case. Below distribution plate 16, an air intake conduit 18 is provided which is disposed to the side of the housing 19 of screening device 3. The air supply conduit 18 provides the screening air which separates the fine bulk material fraction from the insufficiently comminuted bulk material fraction and conducts the fine bulk material fraction to the finished material discharging device 4 above distribution plate 16. Discharging device 4 may be connected with a subsequently arranged cyclone 20 whose exhaust air A may possibly be made available again to screening air conduit 18. Distribution plate 16 is provided with a separate drive 21, with shaft stubs 22 and 23 of vertical impact mill 2 and of screening device 3 being connected with one another by means of a coupling 24 that can be engaged and disengaged as required. Axially below screening air intake conduit 18, a further air supply is provided by way of a bypass line 25. This air is employed to discharge the insufficiently comminuted bulk material fraction. The bottom 26 of screening device 3 is here given a conical configuration 27. The stream of air from bypass conduit 25 imparts a spiral or circular movement to the downward flowing insufficiently comminuted material and conducts it into conveying device 5 which is here configured as a riser pipe. In the region of conveying device 5, bottom 26 is provided with a discharge opening 28 through which the coarse fraction and the excess size grains are introduced into riser pipe 5. A blower G, not shown in detail, generates an upwardly directed stream of air within riser pipe 5 which conducts the coarse material fraction upwardly and charges it at the upper end of riser conduit 5 into a further cyclone 29. Through a conduit 30, the thus separated material is introduced below cellular wheel sluice 7 into the material charging device 6, with it being impossible for any annoying air components to enter into material discharging device 6. The exhaust air B is returned into the region of screening air conduit 18. In order not to create flow conditions that might interfere with the screening process between the screening air intake conduit 18 and bypass air conduit 25, a screen-like device 31 is provided axially between the two intake conduits 18 and 25 so as to essentially fill the interior cross section of screening device 3 through which coarse particles can drop without problems onto the sloped bottom 27 while, however, substantially avoiding an upwardly directed flow component in the bypass air.

Discharging device 4 for the fine fraction may also be in the form of a discharge spiral and a subsequent separating device. This should be made dependent on the respective application and the respective materials involved. If the quantity of air 34 supplied laterally through conduit 18 should not be sufficient to ensure optimum discharging of the fine-grained particles into discharge region 4, it is further possible to supply air 35 from the bottom (see direction of arrow). To prevent the development of interfering flow conditions, the lower housing region 32 is given an approximately cone shape and is provided with air exit openings 33 which serve to support the flow of air 34. Any coarser particles that may have been flung upwardly drop back into region 28 and are thus conducted to riser conduit 5. In order to introduce the stream of air 35 into the region of ventilator wheel 37 in a positive manner, an attachment 36 is placed onto the lower housing portion 32 so as to cover air exit openings 33 and thus produce a positive flow direction toward ventilator wheel 37.

I claim:

1. A device for comminuting and classifying bulk materials, the device comprising a vertical impact mill with associated material charging device, a screening device chargeable with air, a finished material discharging device as well as a conveying device for returning the insufficiently comminuted bulk material fraction into the comminution region, characterized by the combination of the following features:

the vertical impact mill (2) and the screening device (3) are disposed on a divided drive shaft (22, 23);

the screening device (3), which is provided below the vertical impact mill (2), is configured as a distribution plate (16) that is equipped with guide vanes (15) if required;

the air (18) is supplied laterally or tangentially below the distribution plate (16);

the final fractions are discharge laterally or tangentially above the distribution plate (16);

the insufficiently comminuted bulk material fraction is discharged below the distribution plate (16) and is supplied to the conveying device (5) which returns the bulk material fraction into the region of the material charging device (6).

2. A device according to claim 1, characterized by separate drives (10, 21) for the vertical impact mill (2) and the distribution plate (16), with the mutually facing stub shafts (22, 23) of the two drive shafts being connectable with one another by way of a coupling (24) that can be brought into engagement with both shafts.

3. A device according to claims 1, characterized in that the insufficiently comminuted bulk material fraction is dischargeable in the bottom region (26) of the distribution plate (16), with the bottom (26) being sloped (27) in the direction toward a discharge opening (28), with the slope being connected with the conveying device (5).

4. A device according to claims 1, characterized in that the discharging of the insufficiently comminuted bulk material fraction is supported by at least one air intake device (25) disposed laterally or tangentially at the screening device housing (19).

5. A device according to claim 1, characterized in that the air intake device (25) is formed by at least one bypass conduit that can be taken from the screening device air conduit (18).

6. A device according to claim 1, characterized in that a screen-like device (31) which essentially fills the interior cross section of the screening device (3) is provided in the region between the screening device air conduit (18) and the bypass conduit (25).

7. A device according to claim 1, characterized in that the conveying device (5) is configured as a bucket mechanism which transports the insufficiently comminuted bulk material fraction directly to the material charging device (6) above the vertical impact mill (2).

8. A device according to claim 1, characterized in that the conveying device (5) is configured as a riser pipe within which the insufficiently comminuted bulk material fraction can be transported in a stream of air into the region of the material charging device (6) above the vertical impact mill (2).

9. A device according to claim 8, characterized in that at least one separator (29) which separates the stream of air from the bulk material fraction is provided between the free end of the riser pipe (5) and the material charging device (6).

10. A device according to claim 8, characterized in that the separator (29) is configured as a cyclone, with the cyclone discharge (30) opening into the material charging device (6) and the exhaust air (B) being made available again if required to the screening device and/or the discharge air conduit (18, 25).

11. A device according to claim 1, characterized in that the finished material fraction can be discharged (4) laterally or tangentially above the screening device (3) and, if required, may be supplied to a separator (20) in the form of a cyclone, with the exhaust air (A) being made available again to the screening and/or discharging air conduit (18, 25).

12. A device according to claim 1, characterized in that the finished fraction can be discharged through a worm.

13. A device according to claim 1, characterized in that the lower housing region (32) of the screening device (3) has an approximate cone shape and is provided with air exit openings (33) through which a further quantity of air (35) can be supplied from the bottom into the region of the screening device (3).

14. A device according to claim 1, characterized in that the housing region (32) is provided with an attachment (36) whose lower region is provided below the air discharge openings (33) and whose upper end extends into the vicinity of the ventilator wheel (37).

15. A device according to claim 1 wherein said divided drive shaft is couplable.

* * * * *